United States Patent [19]

Eitzinger

[11] 4,271,581

[45] Jun. 9, 1981

[54] APPARATUS FOR INSERTING MULTIPLE TERMINALS INTO A HOLDER

[75] Inventor: Robert Eitzinger, Lincolnshire, Ill.

[73] Assignee: Mid-West Automation, Inc., Wheeling, Ill.

[21] Appl. No.: 78,239

[22] Filed: Sep. 24, 1979

[51] Int. Cl.[3] ..... H01R 43/00

[52] U.S. Cl. ..... 29/564.6; 29/564.2; 29/566.2; 29/884

[58] Field of Search ..... 29/564.2, 566.2, 564.6, 29/881, 884, 33 M

[56] References Cited

U.S. PATENT DOCUMENTS

| | | | |
|---|---|---|---|
| 3,516,157 | 6/1970 | Brown | 29/884 |
| 3,570,099 | 3/1971 | Ackerman et al. | 29/564.1 |
| 3,641,649 | 2/1972 | Busler et al. | 29/564.6 |
| 3,805,356 | 4/1974 | Serrano | 29/566.2 X |
| 3,887,982 | 6/1975 | Belisle | 29/564.6 |
| 3,947,958 | 4/1976 | Bowers | 29/564.2 X |
| 4,068,367 | 1/1978 | Brown | 29/564.6 |

*Primary Examiner*—William R. Briggs
*Attorney, Agent, or Firm*—Edward C. Threedy

[57] ABSTRACT

An apparatus including feeding and assembling mechanisms by which a strip of terminals will be fed into a work station where a plurality of such terminals are separated from the strip and are forcibly inserted into a terminal holder that has been properly indexed in a receiving position. The apparatus provides a single drive source consisting of a plurality of operational cams for sequentially completing the assembly.

8 Claims, 7 Drawing Figures

APPARATUS FOR INSERTING MULTIPLE TERMINALS INTO A HOLDER

SUMMARY OF THE INVENTION

The present invention relates generally to an automatic electrical terminal assembling apparatus which in succession feeds a strip of preformed terminal elements into a work station, clamps the strip between suitable jaws, separates a predetermined number of terminal elements from the strip, advances the jaws and the separated terminal elements through a horizontal plane for frictional insertion into a properly indexed terminal holder.

More particularly, the present invention is concerned with a sequential drive mechanism deriving its motion from a single power source and a series of interrelated cams that produce a vertical movement of parts; a horizontal movement of parts; as well as a lateral movement of parts, all in proper sequential order.

The order of sequential operation commences with a cam feed whereby a preselected number of terminal elements from a continuous strip of preformed terminals are proportionately positioned in a selected work station. The terminal elements are then by cam operation clamped between a fixed jaw and a vertically movable jaw. A preselected number of terminal elements are severed from the strip by a vertically movable tool. While clamped between the jaws a portion of the tool element is moved through a lateral horizontal plane so as to frictionally insert the exposed ends of the severed terminal elements into a properly indexed terminal holder.

DESCRIPTION OF ILLUSTRATIVE DRAWINGS

Figure 1:
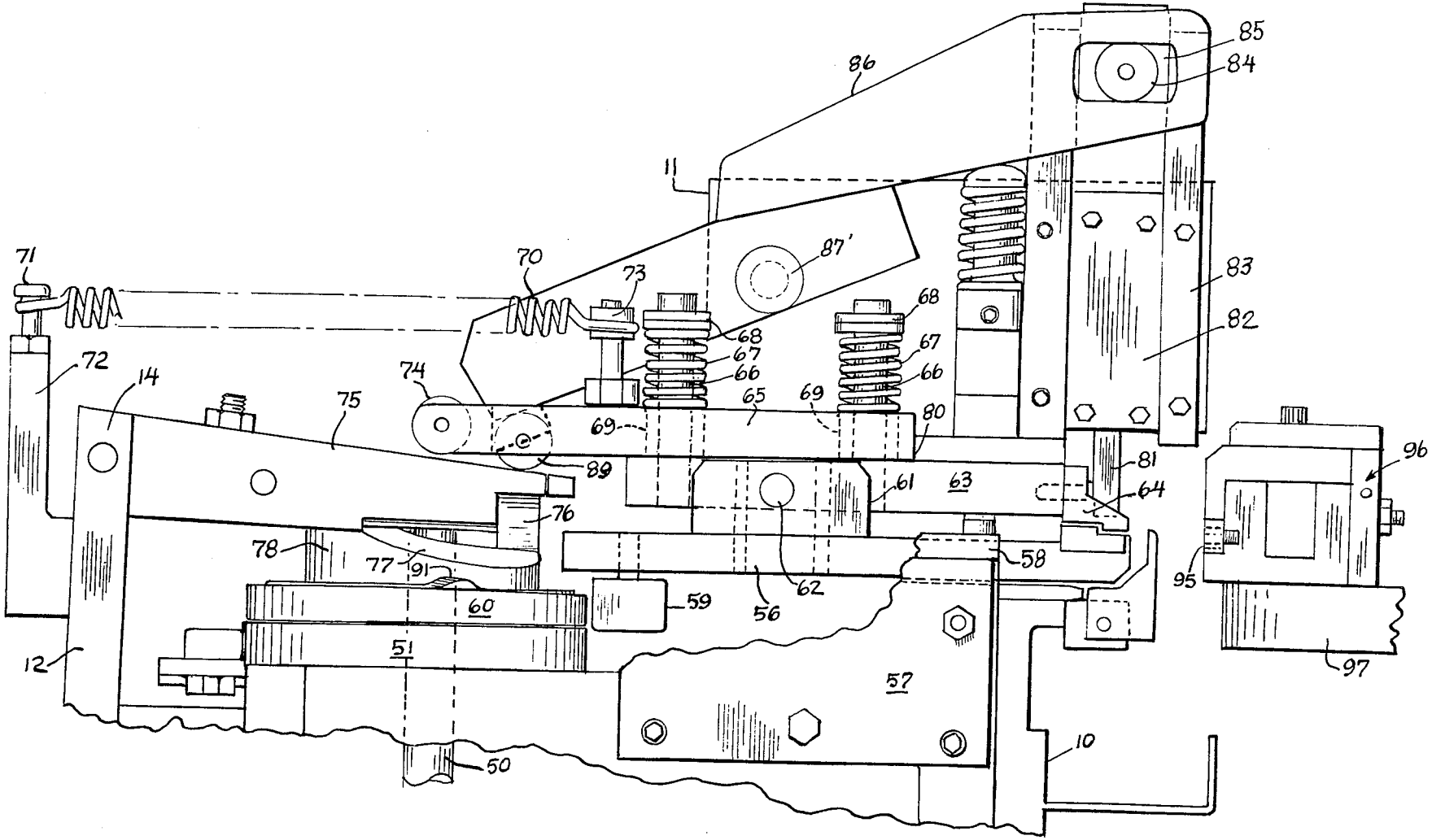
Figures 2, 5, 6:
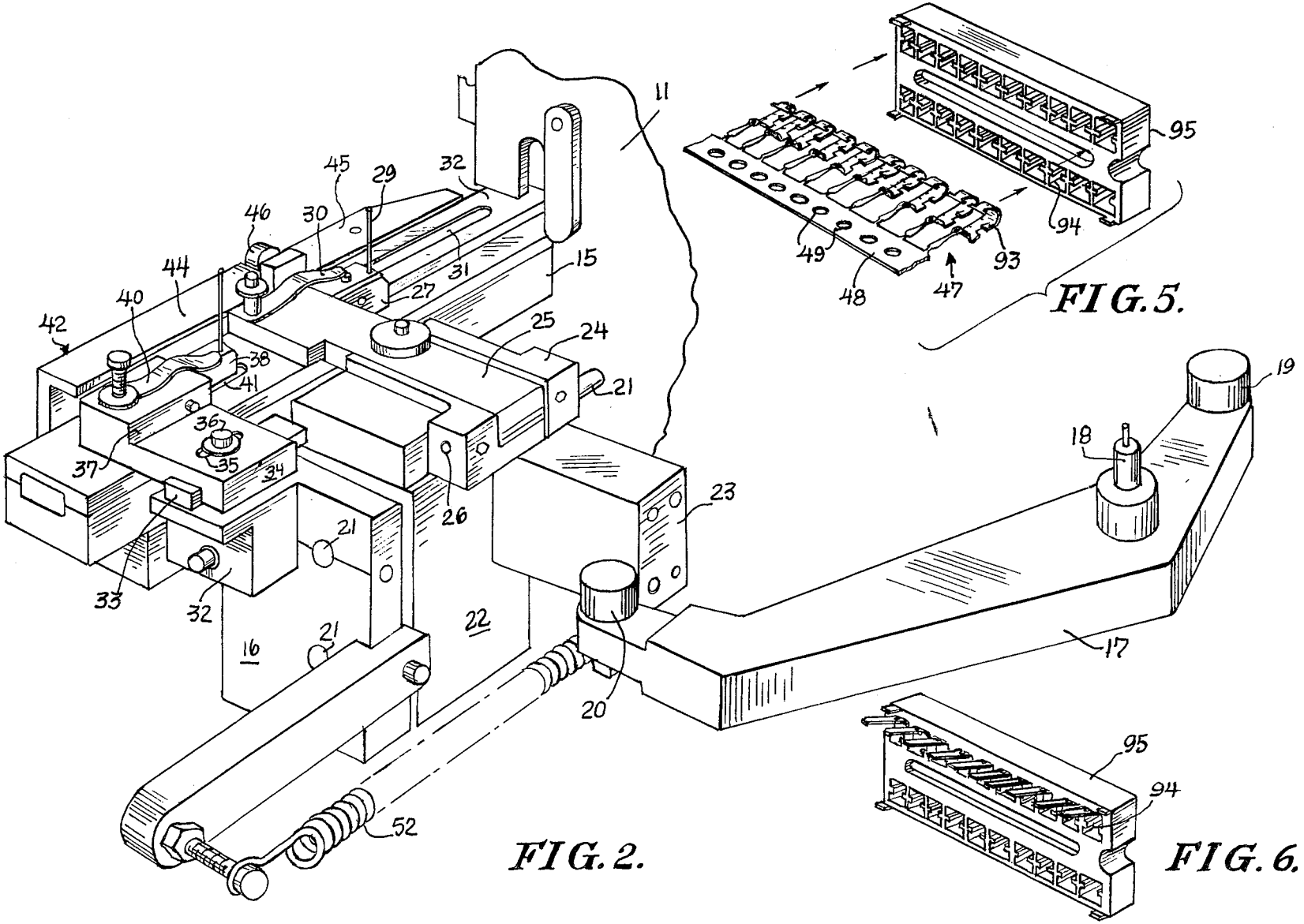
Figure 7:
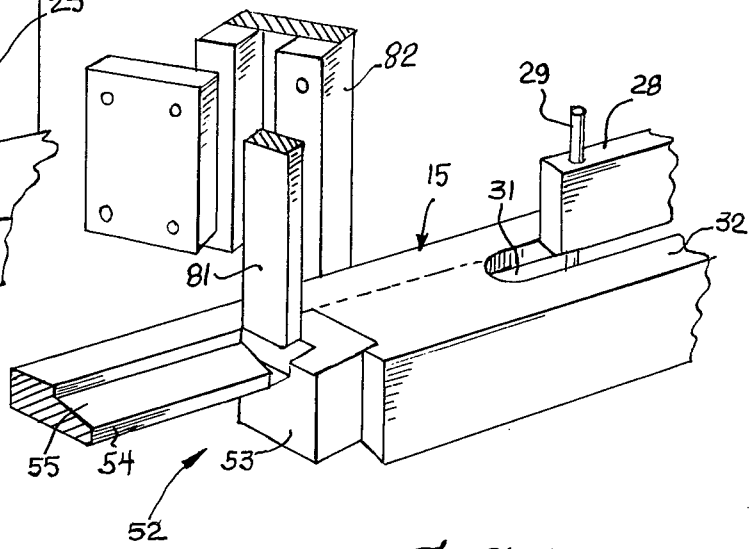
Figure 3:
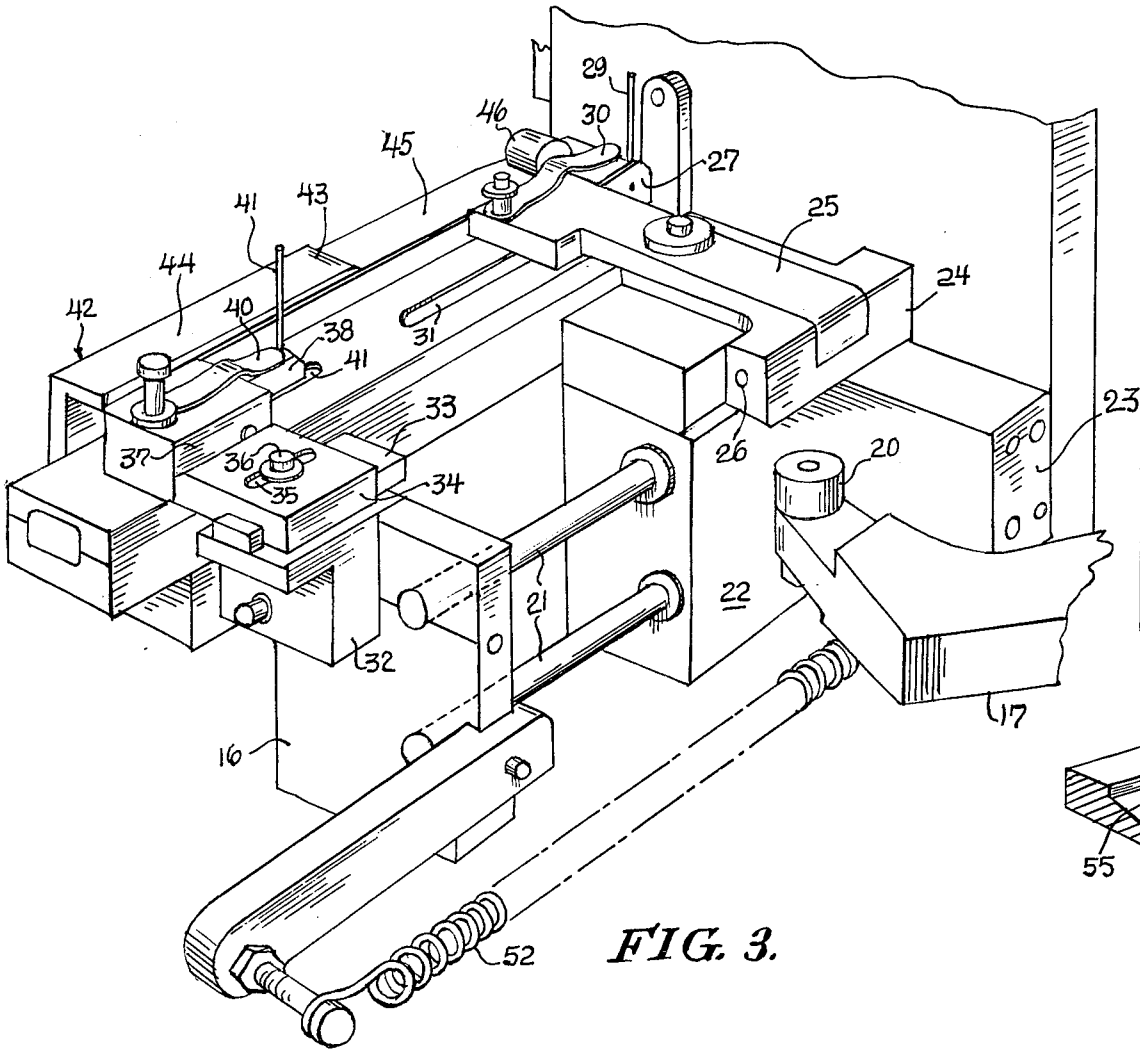
Figure 4:
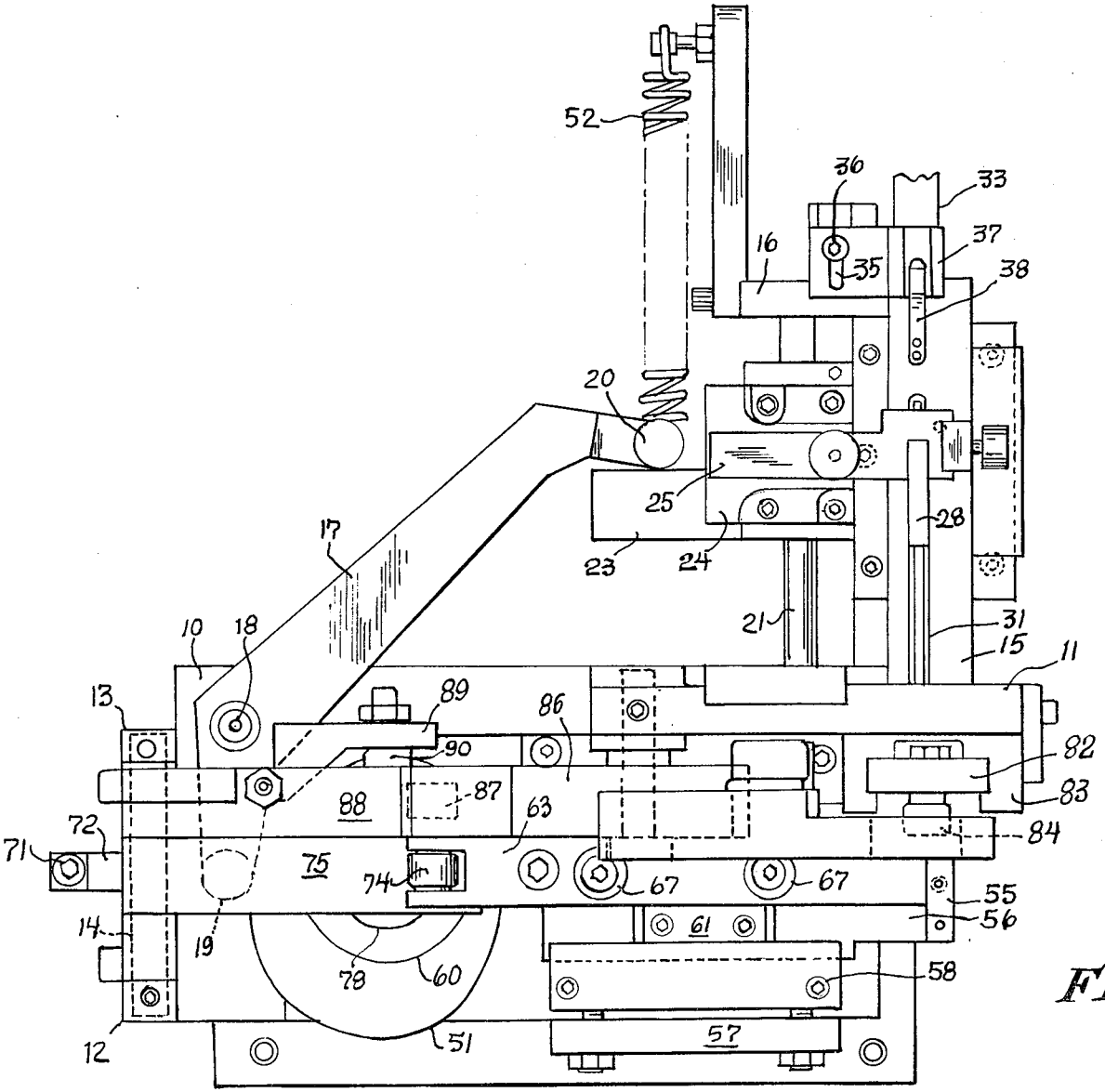

FIG. 1 is a fragmentary side elevational view of the apparatus,

FIG. 2 is a fragmentary perspective view taken from the other side of the apparatus, FIG. 3 is a fragmentary perspective view similar to FIG. 2, but showing parts in operative position, FIG. 4 is a top plan view of the apparatus, FIG. 5 is a perspective view of the terminal holder in preassembled condition, FIG. 6 is a perspective view of the finished terminal holder, and FIG. 7 is a fragmentary perspective view of the work station of the apparatus.

As illustrated in the drawings, the apparatus includes a base 10 and a partial vertical wall 11 supported thereon. To the rear of the base 10 are upstanding pillars 12 and 13 through which is journalled a horizontally extending shaft 14. A hollow track 15 as well as an end plate 16 are supportedly connected to and extended from the vertical wall 11 as seen in FIG. 2.

As shown, an angular arm 17 is by a suitable pin 18 pivotally mounted at the rear of the base 10 adjacent to one of the pillars 13. At one end of the angular arm 17 there is a cam follower 19, while the opposite end of the arm 17 supports a roller 20.

Extending between the end plate 16 and the vertical wall 11 are a pair of vertically aligned rods 21 upon which is slidably mounted a block 22. Carried by the block 22 is a rearwardly extending arm 23 which, as shown in the drawings, is adapted to be engaged by the roller 19 mounted on one end of the angular arm 17.

The head 24 of the block 22 is recessed so as to contain thereon a beam 25, pivotally mounted on a pin 26.

The other end of the head 24 includes a laterally slotted leg 27 that pivotally supports a finger 28, which in turn carries a feed pin 29. A spring member 30 is attached to the head 24 so as to yieldably hold the finger 28 onto the track 15 with the feed pin 29 projecting through an elongated slot 31 formed in the upper wall 32 of the track 15 so as to have an end thereof positioned interiorly of the track for a purpose hereinafter made apparent.

Affixed to the end plate 16 is a second mounting block 32. This block supports a stationary rail 33, which in turn is received in a recess formed in the bottom wall of an adjustable arm 34. As seen in FIGS. 2 and 3, the arm 34 provides a slot 35 through which a bolt 36 projects. By the adjustment of the bolt 36 the arm 34 can be moved upon the rail 33 a distance equal to that of the slot 35.

The arm 34 has a raised portion 37 which is slotted at one side so as to receive a finger 38, which in turn carries a keeper pin 39. A spring member 40 is carried by the top of the enlarged portion 37 of the arm 34 and yieldably maintains the finger 38 upon the track 15 with the keeper pin 39 projecting into a slot 41 formed in the upper wall 32 of the track 15.

As seen in FIGS. 2 and 3, there is to one side of the hollow track 15 a cam rail 42 that provides an inclined ramp 43 separating the rail into a high and low run 44 and 45, respectively.

A roller 46 is carried by the head 24 and is caused to travel over the cam rail 42 as the block 22 is slid over the rods 21. As the roller 46 is carried by the head 24 of the beam 25 the latter will rise or fall as the roller 42 passes over the high and low runs of the ramp 43. This in turn will cause the feed pin 29 to be vertically positioned through the slot 28 during the slidable movement of the block 22 on the rods 21 as hereinafter described.

A strip of terminals 47 are fragmentarily shown in FIG. 5. The terminals include a feed strip 48 which is provided with a plurality of apertures 49 into which the end of the feed pin 29 is yieldably projected when the roller 46 is in engagement with the low run 45 of the cam rail 42. The apertures 49 are also engaged by the yieldable keeper pin 39 so as to prevent reciprocal travel of the terminals 47 through the hollow track 15 when the feed pin 26 is moved through slot 28 in a non-feed direction, which is from right to left, as viewed in FIGS. 2 and 3.

The cam rail 42 is adjustably connected to the side of the track 15 whereby it may be moved longitudinally so as to reposition the high and low runs. This adjustment will determine the length of the strip terminals 47 fed through the track 15, by regulating the distance the feed pin 29 travels through the slot 28.

Carried within the base 10 is a power source such as an electric motor (not shown), which provides a driven rotatable shaft 50 shown in dotted lines in FIG. 1. Mounted upon the shaft above the base 10 is a plurality of operational cams.

As shown in FIG. 1, the lowermost cam 51, which is herein entitled the "feed cam", has its peripheral wall in contact with the cam follower 18 of the angular arm 17. The cam 51 being of elliptical shape as determined by the operational parameters of the apparatus will effect pivoting of the angular arm 17 about the pin 16 so as to cause the roller 19 to engage the block 22 and cause the same to slide over the rods 21 from the position shown in FIG. 2 to that shown in FIG. 3, which in effect will cause a length of the terminal strip to be fed through the hollow track 15 by the feed pin 29 and be positioned into a work station hereinafter described.

A return spring 52 extends between the stationary end plate 16 and the movable block 22 and functions to return the latter to its original position, as seen in FIG. 2, when the cam follower 19 rides on the dwell portion of the feed cam 51.

As viewed in FIG. 7, the work station 52 consists of a die 53 placed at the end of and in communication with track 15. Also included in the work station 52 is the fixed jaw 54 which presents a relieved section 55 which will receive the feed strip 48 of strip of terminals 47.

The fixed jaw 54 is attached to the forward end of a slide plate 56. The slide plate 56 is mounted on the base 10 between a side wall 57 and the vertical wall 11 and is retained therebetween by a cover plate 58 partially covering the top of the slide 56. The rear end of the slide 56 is provided with a cam follower 59. The cam follower 59 responds to a slide cam 60 caused to rotate by the electric motor simultaneiously with the previously described feed cam 51. The slide cam 60, like the feed cam 51, has an eccentric periphery which dictates the forward slidable movement of the slide plate 56.

Mounted upon the slide plate 56 is a connecting block 61 and pivotally mounted on the block 61 by a pivot pin 62 is the upper jaw plate 63. The free end of the upper jaw plate 63 carries the upper jaw 64, which during the feeding of the feed strip 48 into the work station 52 is in elevated position relative to the lower fixed jaw 54.

Adapted to set upon the upper jaw plate 63 is an elongated pivot arm 65. The pivot arm 65 is connected to the upper jaw plate 63 as well as to the slide 56 by a pair of bolts 66. Each of these bolts 66 are encircled by compression springs 67, the upper ends of which bear against suitable washers 68 while their lower ends bear on the pivot arm 65. The bolts 66 extend through enlarged openings 69 in the pivotal arm 65 so that the latter may have a limited lateral movement with respect to the long axis of the bolts 66. A return spring 70 extends between a post 71 mounted on a bracket 72, supported between the pillars 12 and 13, and a bolt 73 attached to the upper surface of the pivot arm 65.

At the rear end of the pivot arm 65 there is a rotatable cam follower 74 which is adapted to rest upon the upper surface of a cam arm 75.

One end of the cam arm 75 is pivotally journalled on the shaft 14 while its opposite end supports a cam roller 76 adapted to ride on the inclined cam face 77 of a clamp cam 78.

The clamp cam 78 like the slide cam 56 and the feed cam 51 is caused to rotate by the driven shaft 50 of the motor so as to rotate in synchronization. After the strip of terminals 47 have been fed as hereinbefore described into the work station 52 the clamp cam 78 will have rotated its inclined face 77 so that the cam roller 76 will have raised the cam arm 75 which in turn through its engagement with the roller 76 will cause the pivot arm 65 to pivot in an upward direction against the expansion of the springs 67 about its corner contact 80 with the upper surface of the jaw plate 63. This action will cause the jaw plate 63 and the movable jaw 62 to move in a downward direction as seen in FIG. 1 so as to clamp the strip of terminals 47 between the jaws 54 and 64.

Adapted to cooperate with the die 53 is a cutoff blade 81 which is slidably contained within a housing 82 which is retained in facial abutment with the vertical wall 11 by a pair of rails 83. The upper end of the housing 82 has mounted thereon a roller 84 which is adapted to be projected into a rectangularly shaped opening 85 formed in the forward end of a cutoff arm 86. By a pin 87' the cutoff arm 86 is pivotally mounted to one side of the vertical wall 11. The inner end of the cutoff arm 86 provides a roller 87 which is adapted to rest upon a pivot plate 88 (see FIG. 4).

Pivot plate 88 has one end journalled on the shaft 14 and is supported intermediate its ends by a trip plate 89 which is angularly displaced to be beneath and to one side of the pivot plate 88. The trip plate 89 is also pivoted on the shaft 14 and provides at its other free end a cam follower 90 which is adapted to ride on the flat surface of the slide cam 60. As shown in FIG. 1, there is a ramp cam 91 which when rotated to pass beneath the cam follower 90 will momentarily pivot the trip plate 89 in a vertical direction. The vertical movement of the trip plate 89 will cause a vertical movement of the pivot plate 88, which in turn through the roller 87 will pivot the cutoff arm 86 about its pivotal connection 87' and against the action of the spring 92 and through its contact with the roller 84 will cause the housing 82 together with the cutoff blade 81 to move with a downward stroke against the die 53 severing that portion of the terminal strip 47 fed into the work station 52 from the remaining strip of terminals still contained within the track 15.

Immediately upon the severing of a selective portion of the strip of terminals the slide cam 60 will have been caused to rotate so as to engage the slide follower 59 causing the entire assembly consisting of the slide, the jaw plate, the lower jaw and upper jaw, together with strip of terminals clamped therebetween, to be moved in a forward direction (left to right as viewed in FIG. 1) wherein the free ends 93 of the terminals will be frictionally projected into respective compartments 94 formed in the terminal holder.

As shown in FIG. 1, the terminal holder 95 is carried by a fixture 96 supported upon a rotatable table 97.

In operation the table 97 is synchronized with the rotation of the operational cams such that a new holder 95 will be indexed adjacent to the work station 52 prior to the action of severing a portion of the terminal strip and the forward movement of the slide plate.

By this operation there is a continuous sequential function resulting in the production of a fully assembled multiple terminal holder as viewed in FIG. 6.

While I have illustrated and described the preferred form of construction for carrying my invention into effect, this is capable of variation and modification without departing from the spirit of the invention. I, therefore, do not wish to be limited to the precise details of construction as set forth, but desire to avail myself of such variations and modifications as come within the scope of the appended claims.

Having thus described my invention what I claim as new and desire to protect by Letters Patent is:

1. An apparatus for inserting multiple terminals into a holder that has been indexed in a terminal receiving position comprising (a) a driving power source for the apparatus, (b) a first means for feeding a predetermine length of a terminal strip into the apparatus through a hollow track lying in a substantially horizontal plane, (c) means driven by said power source for actuating said first means, (d) second means for clamping said predetermined length of the terminal strip in a designated work station provided by the apparatus, (e) means driven by said power source for moving said second means in a substantially vertical plane, (f) third means for severing a predetermined number of terminals from the terminal strip positioned within the designated work station, (g) means driven by said power source for momentarily moving said third means in a substantially vertical plane, (h) a fourth means for projecting the severed terminals out of the designated work station and into the indexed holder, (i) means driven by said power source for moving said fourth means in a lateral direction transversely of the horizontal plane of the hollow track, (j) means for returning said first, second, third and fourth means to their original positions relative to the horizontal track, the designated work station, and the indexed holder after they have been actuated and moved by their respective driven means.

2. An apparatus for inserting multiple terminals into a holder as defined by claim 1 wherein said means driven by said power source for actuating said first means, for moving said second means, for momentarily moving said third means, and for moving said fourth means comprises a plurality of cams rotated by said driving power source, with said cams each having interrelated cam surfaces and dwell positions relative to each other to synchronize the movement of their respective means.

3. An apparatus for inserting multiple terminals into a holder as defined by claim 2 wherein said first means for feeding a predetermined length of a terminal strip into the apparatus comprises a yieldable feed pin projecting into a slot formed in the hollow track and into contact with a portion of a continuous strip of terminals, said pin reciprocally movable through a horizontal plane by a pivot arm actuated by said means driven by said power source for actuating said feeding means.

4. An apparatus for inserting multiple terminals into a holder as defined by claim 3 and including means for determining the time said feed pin projects through the slot formed in the hollow track as it travels reciprocally through a horizontal plane for determining the number of terminals fed through the hollow track into the work station provided by the apparatus.

5. An apparatus for inserting multiple terminals into a holder as defined by claim 2 wherein said second means for clamping said predetermined length of the terminal strip in a designated work station comprises a movable jaw pivotable about a horizontal axis for clamping the length of terminal strip against a fixed jaw positioned in the designated work station with said fixed jaw in horizontal alignment with the hollow track so as to receive the terminal strip therefrom as it is fed by said first means therethrough.

6. An apparatus for inserting multiple terminals into a holder as defined by claim 2 wherein said third means for severing a predetermined number of terminals from the terminal strip comprises a cutting tool movable through a substantially vertical plane to one side of said second means after said second means has clamped said predetermined length of terminal strip in the designated work station.

7. An apparatus for inserting multiple terminals into a holder as defined by claim 2 wherein said fourth means for projecting said severed terminals into the indexed holder comprises a slide plate including said second means and movable laterally with respect to the horizontal and vertical plane of movement of said first means and second means for projecting said severed terminals out of the designated work station and into the indexed terminal holder.

8. An apparatus for inserting multiple terminals into a holder as defined by claim 2 wherein said means for returning all of said means to their original position during their respective cam dwells comprise coil springs.

* * * * *